United States Patent [19]

Lunn

[11] 4,286,535

[45] Sep. 1, 1981

[54] SHIP FOR LIGHTER-THAN-WATER FLUIDS

[76] Inventor: Eugene Lunn, 1217 Gilbert Ave., St. Louis, Mo. 63119

[21] Appl. No.: 74,397

[22] Filed: Sep. 10, 1979

Related U.S. Application Data

[63] Continuation-in-part of Ser. No. 909,253, May 24, 1978, abandoned.

[51] Int. Cl.[3] ..... B63B 25/08

[52] U.S. Cl. ..... 114/74 R; 114/74 T; 114/77 R

[58] Field of Search ..... 9/12; 114/74 R, 74 T, 114/77 R, 323, 324, 325, 326, 327, 328, 329

[56] References Cited

U.S. PATENT DOCUMENTS

| | | | |
|---|---|---|---|
| 876,777 | 1/1908 | Dempster | 114/325 |
| 1,740,948 | 12/1929 | Lear | 114/325 |
| 2,513,004 | 6/1950 | Cooley | 114/74 R |
| 3,672,320 | 6/1972 | Mikk | 114/74 R |

FOREIGN PATENT DOCUMENTS

| | | | |
|---|---|---|---|
| 755198 | 9/1933 | France | 114/336 |
| 759500 | 11/1933 | France | 114/325 |
| 10087 | of 1912 | United Kingdom | 114/324 |

*Primary Examiner*—George E. A. Halvosa
*Attorney, Agent, or Firm*—Rogers, Eilers & Howell

[57] ABSTRACT

A ship has a plurality of open-top recesses in the deck thereof in which substantially fluid-tight, relatively light-weight, buoyant containers are held solely by the force of gravity and by frictional forces. Those containers substantially fill those recesses. If the ship were to sink, the containers would automatically eject, responding to the weight of the water which they displaced to rise up out of those recesses and float upright in open water. Thereafter, those buoyant containers would confine the contents thereof until those containers could have the contents thereof transferred into other ships at sea or could be towed to shore to be emptied, thereby preventing accidental spills of oil or other liquid cargo.

12 Claims, 3 Drawing Figures

SHIP FOR LIGHTER-THAN-WATER FLUIDS

CROSS REFERENCE TO RELATED APPLICATION:

This application is a continuation-in-part of my copending application Ser. No. 909,253 which was filed on May 24, 1978, now abandoned for Means For Preventing Accidental Oil Spills And Other Cargo In Oceans, Lakes And Inland Waterways.

BACKGROUND OF THE INVENTION

1. Field of the Invention

Many crude oils are lighter than water, particularly sea water; and hence crude oils tend to float when a tanker has its liquid-tight integrity impaired by a storm, an accident, an act of man, or otherwise. That crude oil can be highly objectionable in an ecological sense, in an economic sense, and in a recreational sense. Consequently, it would be desirable to construct ships which would minimize the loss of crude oil or other lighter-than-water fluids in the event the liquid-tight integrity thereof was impaired. 2. Description of the Prior Art Wells U.S. Pat. No. 3,556,036 discloses a Deep Sea Cargo Vessel which is submerged so large cargo barges can be floated into position above it; and those cargo barges are supposed to be "firmly seated on the cargo deck" as that "vessel is resurfaced".

Cushing et al U.S. Pat. No. 3,823,681 discloses a Barge Carrying Transport Vessel which is submerged so barges can be floated into position above it; and those barges are supposed to be held in position within that vessel by tapered male pins 55 and corresponding female apertures 56.

Mikk U.S. Pat. No. 3,672,320 discloses a Ship For Containerized Cargo wherein "a plurality of vertically extending receptacles 13" accommodate "removably placed containers 14 containing oil or the like. A plurality of latches 19 may be positioned at the upper end of the oil tank container so as to secure the same within the compartment. Below the oil tank container there is positioned an ejection mechanism 20. A water level sensor 21 for activating the ejection mechanism 20 is located within the compartment 13 near a lower end thereof.**"

SUMMARY OF THE INVENTION

The present invention provides a ship which has a plurality of longitudinally-displaced and transversely-displaced open-top recesses in the deck thereof; and a corresponding plurality of substantially fluid-tight, relatively light-weight containers are held within those recesses solely by the force of gravity and by frictional forces. Those containers substantially fill those recesses to make those open-top recesses substantially closed-top recesses. In doing so, those containers obviate the cost, the weight, the handling, and the maintenance of hatches for those recesses. It is, therefore, an object of the present invention to provide a ship which has a plurality of longitudinally-displaced and transversely-displaced open-top recesses in the deck thereof; and to provide a corresponding plurality of substantially fluid-tight relatively light-weight containers that are held within those recesses soley by the force of gravity and by frictional forces, and that substantially fill those recesses to make those open-top recesses substantially closed-top recesses.

The horizontal area of the open top of each recess is larger than the horizontal area of the bottom of that recess; and the walls of the recesses are formed so they will not obstruct or hinder upward release of the containers relative to those recesses. Where those containers are filled with lighter-than-water fluids such as crude oil, those containers will respond to a sinking of the ship to rise up out of the recesses and float, because the weights of the volumes of water displaced by those containers will be substantially larger than the filled weights of those containers. Thereafter, those containers will float; so the contents thereof can be transferred at sea or after those containers have been towed to shore. It is, therefore, an object of the present invention to make the horizontal areas of the open tops of open-top recesses in the deck of a ship larger than the horizontal areas of the bottoms of those recesses, and to make the walls of those recesses so they will not obstruct or hinder upward movement of containers relative to those recesses.

The walls of the open-top recesses are made so they can receive, and provide substantial lateral support for, the walls of the containers. Further, those containers are, except in the event the ship sinks, intended to be installed empty in that ship and remain there for the life of that ship. As a result, those containers do not have to be built with heavy, thick metal walls to hold and support cargo, as in the case of shipboard cargo containers. Hence those containers can be made relatively light in weight. Normally, the walls of the open-top recesses will provide the external support which is required by the containers. In the event the ship were to sink, the water would provide external support for the walls of the containers. It is, therefore, an object of the present invention to make the walls of the open-top recesses of a ship so they can receive, and provide substantial lateral support for, the walls of containers disposed within those recesses.

The walls of the containers provided by the present invention may respond to the filling of those containers with fluids to bow slightly outwardly into intimate engagement with the inner surfaces of the open-top recesses therefor. That slight outward bowing positively prevents any shifting of those containers relative to those recesses, even when the ship rolls and tosses in heavy storms. However, the walls of the containers will respond to water, which will enter at the base of the open-top recesses in the event the ship sinks, causing the cargo containers to slide upward along the inner surfaces of those recesses, and thereby will automatically reduce the forces between those containers and those recesses. As a result, although those containers normally fit snugly within the open-top recesses therefore, those containers will respond to the weight of the water which they displace to rise upwardly out of the recesses if the ship sinks. It is, therefore, an object of the present invention to provide substantially fluid-tight, relatively light-weight containers with sides that can respond to the filling of those containers with fluids to bow into intimate engagement with the inner surfaces of the recesses for those containers.

Other and further objects and advantages of the present invention should become apparent from an examination of the drawing and accompanying description.

In the drawing and accompanying description, a preferred embodiment of the present invention is shown and described but it is to be understood that the drawing and accompanying description are for the purpose of illustration only and do not limit the invention and that the invention will be defined by the appended claims.

DETAILED DESCRIPTION OF PREFERRED EMBODIMENT

Figure 1:
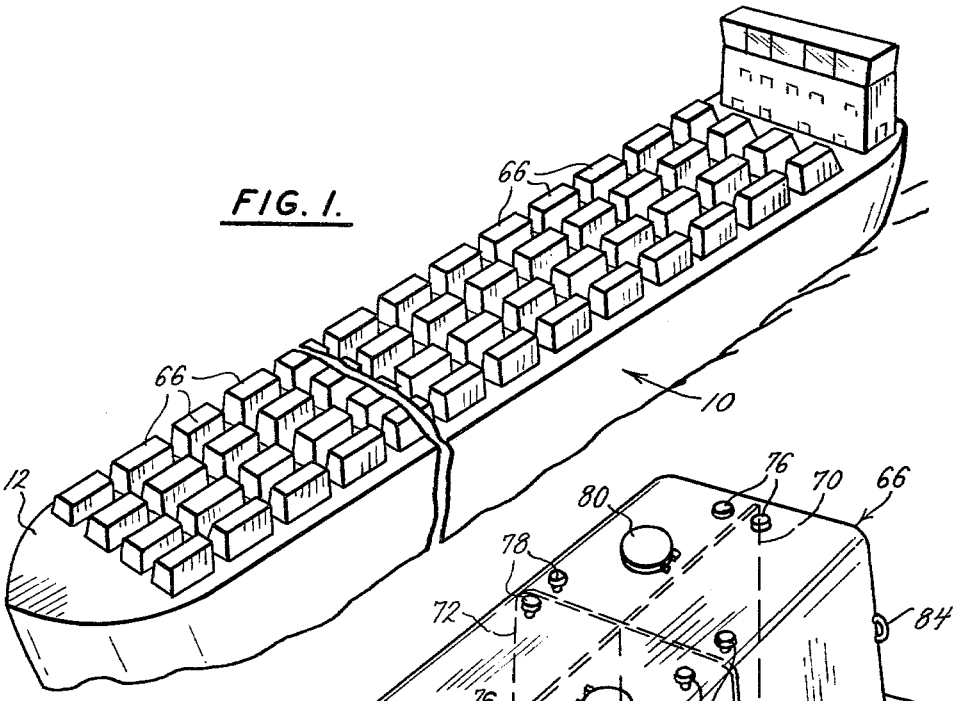
FIG. 1 is a broken perspective view of one preferred embodiment of ship that is made in accordance with the principles and teachings of the present invention.
Figure 2:
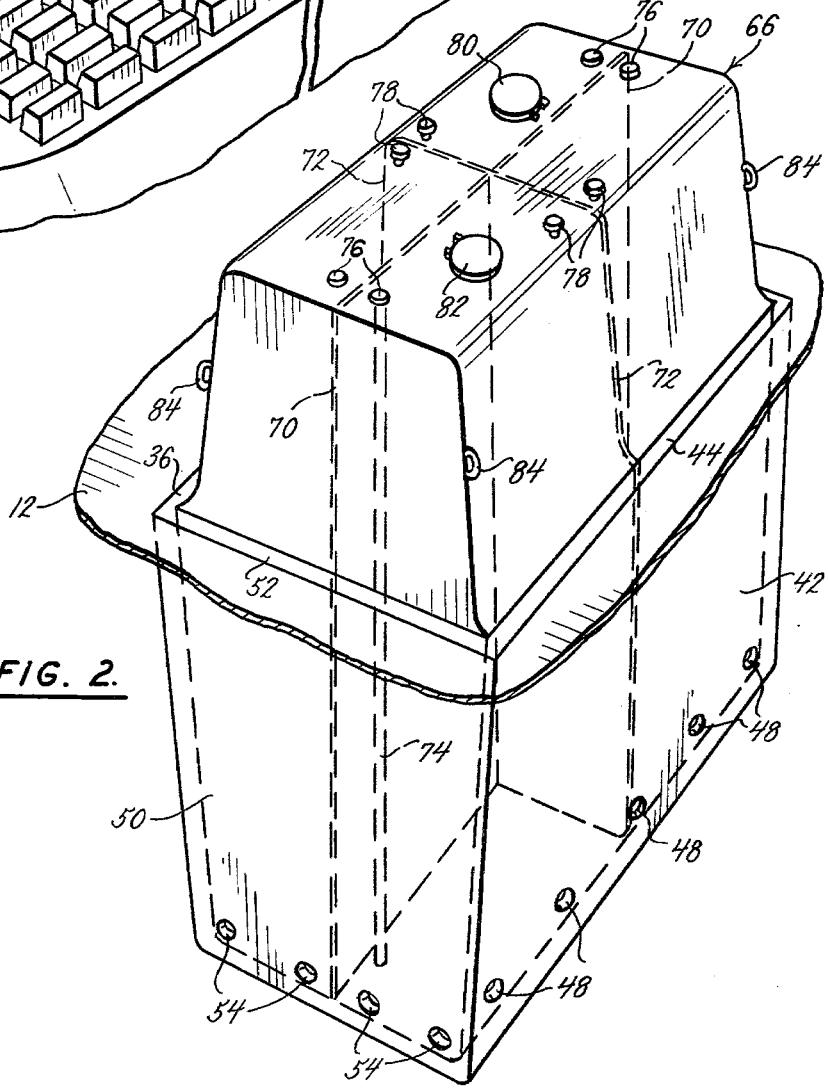
FIG. 2 is a perspective view, on a larger scale, of a part of the deck of the ship of FIG. 1, of a recess which extends downwardly from that deck, and of a container which is disposed within that recess.

Referring to the drawing in detail, the numeral 10 generally denotes a ship which embodies the principles and teachings of the present invention. The deck 12 of that ship has a plurality of longitudinally-displaced and transversely-displaced openings therein; and open-top sturdy recesses are disposed within, and help define, those openings.

Figure 3:
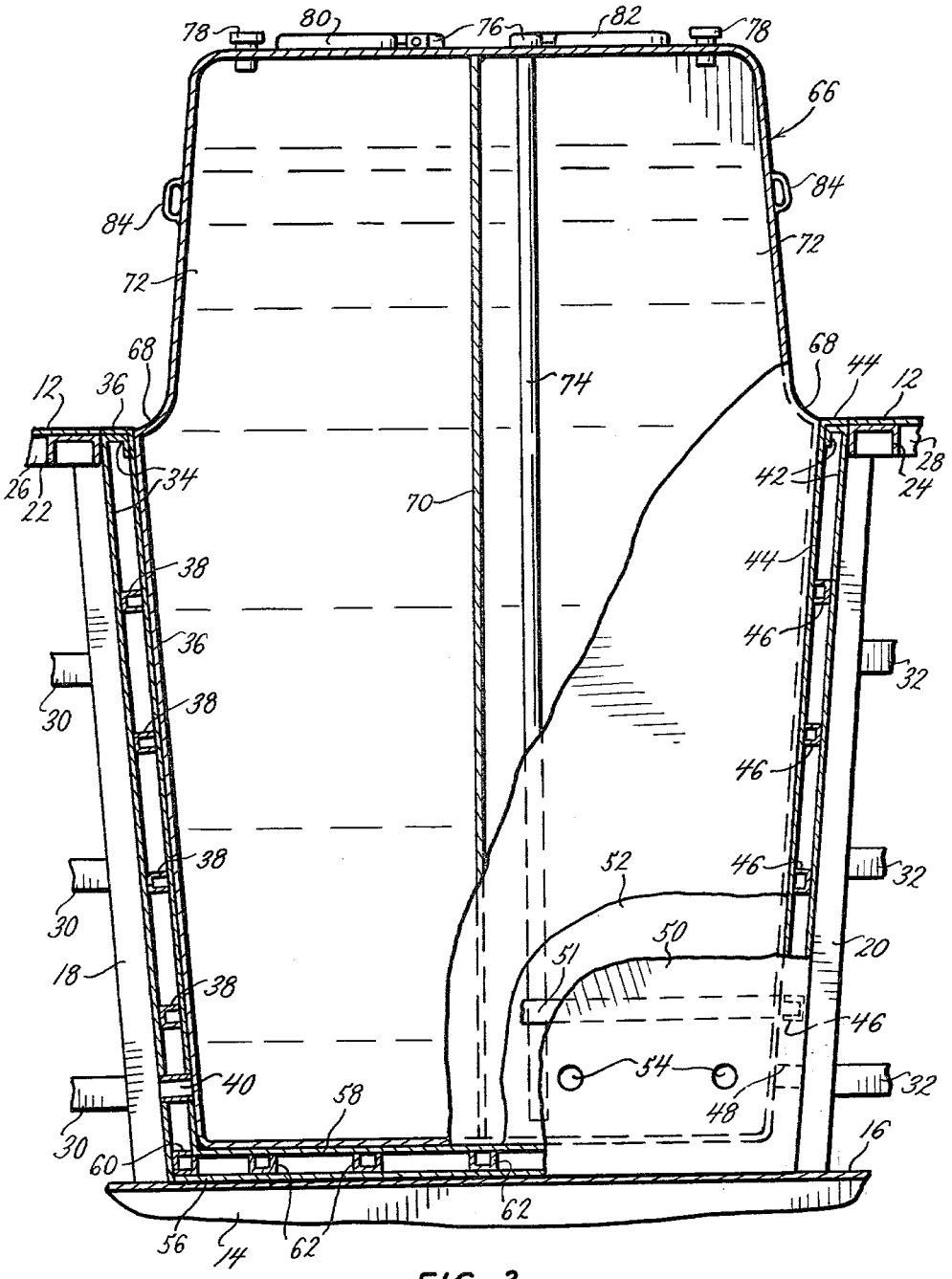
FIG. 3 is a partially broken-away vertical section, on a still larger scale, through the container and recess of FIG. 2 and of adjacent portions of the structure of the ship of FIG. 1.

Referring particularly to FIG. 3, the numeral 14 denotes a horizontally-disposed structural support which extends transversely of the hull of the ship 10 and which is rigidly secured to that hull to reinforce and strengthen that hull. That support is sturdy; and it is braced by further structural members, not shown, which extend downwardly to the keel and to other portions of the bottom of the hull of that ship. The numeral 16 denotes plate-like decking which overlies the structural support 14, and also overlies further horizontally-disposed structural supports 14, not shown, which are essentially identical to, which are disposed fore and aft of, and which are aligned with, the structural support 14. Inclined struts 18 and 20 incline upwardly from the structural support 14 and diverge from each other, as shown particularly by FIG. 3. Further inclined struts 18 and 20, not shown, which are essentially identical to, and which are disposed fore and aft of, the struts 18 and 20 are secured to and diverge upwardly from the further horizontally-disposed structural supports 14, not shown, that are essentially identical to, that are fore and aft of, and that are aligned with the structural support 14. Longitudinal channels 22 and 24 are rigidly secured to the upper ends of the inclined struts 18 and 20 and to the upper ends of further inclined struts 18 and 20, not shown, that are essentially identical to the struts 18 and 20.

Transversely-directed channels 26 extend from the longitudinally-extending channel 22 to the starboard side of the ship 10 or to the longitudinally-extending channel 24 of the next-adjacent group of inclined struts 18 and 20 and longitudinally-extending channels 22 and 24. Further transversely-directed channels 26, not shown, which are essentially identical to, and which are disposed fore and aft of, the channel 26 extend from the channel 22 to further portions of the starboard side of the ship or to further portions of the longitudinally-extending channel 24 of the next-adjacent group of inclined struts 18 and 20 and longitudinally-extending channels 22 and 24.

The numeral 28 denotes a transversely-directed channel which extends from the longitudinally-extending channel 24 to the port side of the ship 10 or to the longitudinally-extending channel 22 of the next-adjacent group of inclined struts 18 and 20 and longitudinally-extending channels 22 and 24. Further transversely-directed channels 28, not shown, which are essentially identical to, and which are disposed fore and aft of, the channel 28 extend from the channel 24 to further portions of the port side of the ship or to further portions of the longitudinally-extending channel 22 of the next-adjacent group of inclined struts 18 and 20 and longitudinally-extending channels 22 and 24.

The upper ends of all of the inclined struts 18 and 20 are welded to the under surface of the deck 12. Similarly, the upper surfaces of all of the channels 22, 24, 26 and 28 are welded to the under surface of the deck 12. In addition, those struts are welded to those channels, to the horizontally-disposed supports 14, and to the decking 16. The confronting faces of the channels 22 and 24 help define the longitudinally-displaced and transversely-displaced openings in the deck 12.

Horizontally-disposed braces 30 extend from the inclined struts 18 to the starboard side of the ship or to the inclined struts 20 of the next-adjacent group of inclined struts 18 and 20 and longitudinally-extending channels 22 and 24. Further horizontally-disposed braces 30, not shown, that are displaced fore and aft of, and that are essentially identical to, the braces 30 extend from the further inclined struts 18 to the starboard side of the ship or to the inclined struts 20 of the next-adjacent group of inclined struts 18 and 20 and longitudinally-extending channels 22 and 24. Horizontally-disposed braces 32 extend from the inclined struts 20 to the port side of the ship or to the inclined struts 18 of the next-adjacent group of inclined struts 18 and 20 and longitudinally-extending channels 22 and 24. Further horizontally-disposed braces 32, not shown, that are displaced fore and aft of, and that are essentially identical to, the braces 32 extend from the further inclined struts 20 to the port side of the ship or to the inclined struts 18 of the next-adjacent group of inclined struts 18 and 20 and longitudinally-extending channels 22 and 24.

The braces 30 and 32 are welded to the various struts 18 and 20 or to the port or starboard sides of the ship. Those braces are continuous from the sides of the ship to the struts of the adjacent groups of inclined struts 18 and 20 and longitudinally-extending channels 22 and 24, and also are continuous between the struts of each group of inclined struts 18 and 20 and longitudinally-extending channels 22 and 24.

The horizontally-disposed structural supports 14, the plate-like decking 16, the groups of inclined struts 18 and 20 and longitudinally-extending channels 22 and 24, the transversely-directed channels 26 and 28, and the braces 30 and 32 coact to define a sturdy and rugged framework. That framework extends from a point near the bow of the ship 10 to a point near the stern of that ship; and it constitutes a basic part of the strength-providing structure of that ship. As a result, the ship 10 can be extremely sturdy, and yet be relatively light in weight.

The numeral 32 denotes a plate which has the upper end thereof bent to provide a horizontally-directed flange and a downwardly-extending lip. That plate has the outer face thereof welded to the inner faces of two or more of the inclined struts 18. The numeral 38 denotes a plurality of longitudinally-extending, horizontally-disposed, vertically-spaced channels which have the webs thereof welded to the inner face of the plate 34. The numeral 36 denotes a plate which has the upper end thereof bent outwardly to define a flange that overlies and that is welded to the horizontally-directed flange at the upper end of plate 34. The left-hand edge of the horizontally-directed flange at the upper end of plate 36 is welded to the channel 22 and to the deck 12. As shown particularly by FIG. 3, the flange-like bent upper end of plate 36 is at the level, and effectively serves as a part, of the deck 12. A number of tubular passages 40 extend outwardly and downwardly from the inner face of plate 36 to and through the outer face of plate 34.

The numeral 42 denotes a plate which has the upper end thereof bent to define a horizontally-directed flange and a downwardly-directed lip. That plate has the outer face thereof welded to the inner faces of two or more of the inclined struts 20. The numeral 46 denotes a plurality of longitudinally-extending horizontally-disposed, vertically-spaced channels which have the webs thereof welded to the inner face of the plate 42. The numeral 44 denotes a plate which has the upper end thereof bent outwardly to define a flange that overlies and that is welded to the horizontally-directed flange at the upper end of plate 42. The right-hand edge of the horizontally-directed flange at the upper end of plate 44 is welded to the channel 24 and to the deck 12. As shown particularly by FIG. 3, the flange-like bent upper end of plate 44 is at the level, and effectively serves as a part, of the deck 12. A number of tubular passages 48 extend outwardly and downwardly from the inner face of plate 44 to and through the outer face of plate 42.

The numeral 50 denotes a plate of frusto-triangular configuration which has the edges thereof welded to the adjacent edges of the plates 34 and 42 and also to the ends of the channels 38 and 46. Transversely-extending, horizontally-disposed, vertically-spaced channels 51 have the ends thereof welded to the ends of the channels 38 and 46 and have the webs thereof welded to the inner surface of plate 50. The numeral 52 denotes a plate of frusto-triangular configuration which has the edges thereof welded to the ends of the plates 36 and 44, and which has the outer surface thereof welded to the transversely-extending channels 51. Although only portions of the plates 50 and 52 are shown, the plate 52 will constitute a closure for the end of the truncated V defined by the plates 36 and 44; and the upper edge of that plate will be bent horizontally outwardly to constitute a flange that extends, and is welded, to the deck 12. Similarly, although only a portion of the plate 50 is shown, that plate will constitute a closure for the end of the truncated V defined by the plates 34 and 42; and the upper edge of that plate will be bent horizontally inwardly and will have a downwardly-directed lip. The horizontal flange at the upper edge of plate 50 will underlie, and will be welded to, the horizontal flange at the upper edge of the plate 52. A number of tubular passages 54 extend outwardly and downwardly from the inner surface of the plate 52 to and through the outer surface of the plate 50.

The numeral 56 denotes a plate which is welded to the lower edges of the plates 34 and 42; and that plate will be welded to the decking 16. A reinforcing tube 60 is welded to the lower end of the plate 34 and to the left-hand end of the plate 56. A similar reinforcing tube, not shown, is welded to the lower end of the plate 42 and to the right-hand edge of the plate 56. A number of longitudinally-extending, horizontally-disposed, horizontally-spaced channels 62 have the webs thereof welded to the upper surface of the plate 56. A plate 58 is welded to the lower edges of plates 36 and 44, and also is welded to the reinforcing tube 60 and to its counterpart, not shown, adjacent the right-hand edge of plate 58. In addition, the plate 58 is welded to the reinforcing channels 62.

A set of end plates, which are identical in configuration to the end plates 50 and 52, and a set of reinforcing channels which are identical to the reinforcing channels 51, are provided at the opposite ends of the side plates 34, 36, 42, 44, 56 and 58. Those end plates, the end plates 50 and 52, the side plates 34, 36, 42 and 44, the channels 38, 46, 51 and the channels between the end plates, not shown, the reinforcing tube 60 and the reinforcing tube, not shown, coact to define a sturdy, inverted, frusto-pyramidal recess which can be prefabricated and then welded within the hull of the ship or which can be fabricated in place within that hull. When mounted within the hull of ship 10, that recess will coact with other essentially identical sturdy, inverted, frusto-pyramidal recesses to define a plurality of longitudinally-displaced and transversely-displaced recesses in the deck 12. The various inverted frusto-pyramidal recesses will coact with the horizontally-disposed structural supports 14, the plate-like decking 16, the groups of inclined struts 18 and 20 and longitudinally-extending channels 22 and 24, the transversely-directed channels 26 and 28, and the braces 30 and 32 to provide a "honeycomb" or "egg crate" reinforcing structure for the ship 10. As a result, that ship can be made very strong but relatively light in weight. If desired, tubular passages could be provided in the bottoms of the recesses.

The numeral 66 generally denotes a container that has an inverted frusto-pyramidal configuration for the lower portion thereof which is complementary to, but smaller than, the frusto-pyramidal configuration of the recess which is defined by the walls 36, 44, 52, 58, and the counterpart of wall 52. The fact that the inverted frusto-pyramidal lower portion of container 66 is smaller than the inverted frusto-pyramidal recess therefor facilitates ready insertion of that container into that reason, facilitates full "bottoming" of that container within that recess, and facilitates the rising of that container out of that recess in the event the ship 10 were to sink. The upper portion of the container 66 has a frusto-pyramidal configuration which is very much smaller than the pyramidal configuration of the lower portion of that container; and an offset 68 spaces the lower edge of that upper portion inwardly from the upper edge of that lower portion. The numeral 70 denotes a longitudinally-extending, vertically-disposed, partition within the container 66. The bottom, end and top edges of that partition are welded to the bottom, ends and top of container 66. The numeral 72 denotes a transversely-extending, vertically-disposed partition which is made in two parts, and which has the bottom, side and top edges thereof welded to the bottom, sides and top of container 66. The confronting edges of the two sections of partition 72 are welded to the partition 70. The partitions 70 and 72 coact to subdivide the container 66 into four essentially-equal fluid-tight compartments.

The numeral 74 denotes a pipe which is fixedly mounted in the top of the container 66; and that pipe extends downwardly to a point close to the bottom of that container. Suitable struts or reinforcements, not shown, will extend between the partition 70 and that pipe to prevent any movement of that pipe relative to container 66. A cap 76 is provided for the upper end of that pipe to normally keep that pipe closed. Similar pipes 74 and similar caps 76 are provided for the other three compartments which are defined within the container 66 by the partitions 70 and 72. The numeral 78 denotes a pressure relief vent which is fixedly mounted in the top of container 66; and that vent is in communication with one of the four compartments in that container. That vent constitutes an automatic pressure-relief vent which will permit air to escape from that compartment in the event the container 66 is loaded in a temperate zone and the ship subsequently sails to the torrid zone. However, that vent will not permit water to pass through it and enter the container 66. Similar pressure-relief vents are provided for the other three compartments of container 66. The numerals 80 and 82 denote manholes which are releasably secured to the top of container 66 and which communicate with two of the compartments within that container. Those manholes will be used by the welders who weld the partitions 70 and 72 in position, and also will be used for inspection and maintenance purposes. If desired, manholes may be provided for all four of the compartments of container 66. Eyes 84 are provided at the exterior of the upper portion of the container 66, and those eyes can accommodate cables. Those cables could be used to lower the container 66 into the inverted frusto-pyramidal recess therefor. Also, those eyes could be used for cables to enable the container 66 to be towed, or positioned, at sea by a salvage vessel in the event the ship 10 were to sink.

As indicated by FIG. 1, the ship may have a large number of containers 66. Further, as indicated by FIG. 1, those containers are arranged in longitudinally-extending transversely-spaced rows. In one preferred embodiment of the present invention, each of the containers 66 is forty feet long and is between eight and twenty feet wide at its point of maximum width. The widths of those containers will be functions of the width of the ship and of the number of transversely-spaced longitudinally-directed rows of containers which are desired.

The partition 72 and the end walls of each container 66 will provide fixed transverse dimensions and configurations for the midpoint and ends of that container; and those transverse dimensions will be an inch or more smaller than the transverse dimension of the inverted frusto-pyramidal recess for that container. The portions of the side walls of the container 66 which are intermediate the end walls and the partition 72 will be constructed to have the same transverse configurations and dimensions as that partition and those end walls. Consequently, the container 66 can readily be lowered into, and can readily rise out of, the inverted frusto-pyramidal recess therefor. However, when oils or other fluids are introduced into the compartments of that container, via the pipes 74, those portions of the side walls of that container which are spaced from the end walls and from the partition 72 may bow outwardly into intimate engagement with corresponding portions of the inner surfaces of plates 36 and 44. The engagements between the outwardly bowed portions of those side walls and the corresponding portions of inner surfaces of plates 36 and 44 will be so intimate that any and all shifting of the containers 66 relative to the hull of ship 10 will be prevented.

The containers 66 can be made light enough to permit portions of the side walls thereof to bow outwardly; because the only times those containers have to support loads is when those containers are disposed within, and are fully supported by, the inverted frusto-pyramidal recesses therefor. Specifically those containers are empty when they are initially lowered into the inverted frusto-pyramidal recesses therefor; and hence they do not have to support any loads at that time. The lower portions of those containers will be disposed within, and will be fully supported by, the inverted frusto-pyramidal recesses therefor at all times when those containers are being filled, are holding fluids, or are being emptied. The only times the containers 66 will be removed from the inverted frusto-pyramidal recesses therefor are when those containers are removed for coating the exteriors thereof, or when they float out of those inverted frusto-pyramidal recesses in the event the ship sinks. When those containers are removed from the inverted frusto-pyramidal recesses therefor for application of exterior protective coatings, they will be empty and will not have to support any loads. When those containers float out of the inverted frusto-pyramidal recesses therefor in the event the ship sinks, the water will support the bottoms and sides of those containers. As a result, the containers 66 can be made relatively light in weight, and yet can perform their normal and their emergency functions.

In the event the ship 10 were to sink, water would enter the inverted frusto-pyramidal recesses for the containers 66 via the tubular passages 40, 48, 54 and the tubular passages at the other ends of the recesses. The total weight of each container 66 and of its lighter-than-water contents would be substantially less than the weight of a corresponding volume of water; and hence those lighter-than-water contents will apply upwardly-directed forces to those containers. The water which enters the tubular passages 40, 48 and 54 and the tubular passages at the other ends of the recesses will tend to flex inwardly any outwardly-bowed portions of the side walls of the containers 66, and hence disengage those portions from the plates 36 and 44. Because those containers are held within the recesses therefor solely by the force of gravity and by frictional forces, those containers will respond to the substantial differences between the weights of the water which they displace and the total weights of those containers and of the lighter-than-water contents thereof to rise upwardly out of those recesses and remain afloat on the surface.

If each of the containers 66 was built forty (40) feet long and had a transverse cross section of sixty-four (64) square feet, each such container would be the same size as, but could be more than one thousand (1,000) pounds lighter than, the standard forty (40) foot shipboard containers that are currently being used on container-type ships. More specifically, a forty (40) foot container 66 which had a sixty-four (64) square foot cross section could weigh less than forty-five hundred (4500) pounds, whereas a standard Freuhauf container having that length and cross section weighs five thousand six hundred and thirty (5630) pounds and a Strick container having that length and cross section weights five thousand seven hundred (5700) pounds. Even if the container 66 was made so it had an outside-to-inside volume ratio which was no greater than the outside-to-inside volume ratio of currently-used shipboard containers for use on container-type ships, fresh water would provide substantial lifting forces for that container, and sea water would provide even greater lifting forces for that container. Thus, the outside dimensions of a standard forty (40) foot Freuhauf shipboard container are forty

(40) feet by eight (8) feet by eight (8) feet, or a total of two thousand five hundred and sixty (2560) cubic feet; and the inner dimensions of that container are substantially thirty-nine and sixty-six hundredths (39.66) feet by seven and seventy-one hundredths (7.71) feet by seven and forty-two hundredths (7.42) feet, or a total of two thousand two hundred and sixty-eight and eighty-nine hundredths (2268.89) cubic feet. The weight of fresh water displaced by such a container would be two thousand five hundred and sixty (2560) multiplied by sixty-two and four-tenths (62.4) or one hundred and fifty-nine thousand seven hundred and forty-four (159,744) pounds. The weight of oil which has a specific gravity of ninety-three one-hundredths (0.93) and a volume of two thousand two hundred and sixty-eight and eighty-nine hundredths (2268.89) cubic feet is one hundred and thirty-one thousand, five hundred ninety-five and sixty-two hundredths (131,595.62) pounds. That weight plus the forty-five hundred (4500) pound weight of container 66 would be substracted from the one hundred and fifty-nine thousand seven hundred and forty-four (159,744) pounds to provide a net lifting force of twenty-three thousand six hundred and forty-eight and thirty-eight hundredths (23,648.38) pounds. Those lifting forces are almost twelve (12) tons, they will be applied to each container 66, and they are more than adequate to cause each such container to rise upwardly out of the recess therefor. The weight of sea water is approximately sixty-three and ninety-nine hundredths pounds per cubic foot, and hence the net lifting force exerted by sea water on each container 66 would be one hundred sixty-three thousand eight hundred and four pounds (163,804) less the one hundred and thirty-six thousand and ninety-five and sixty-two hundredths (136,095.62) pounds combined weight of each container and its contents. The resulting net lifting forces of twenty-seven thousand seven hundred and eight and thirty-eight hundredths (27,708.38) pounds are more than thirteen and one-half (13 ½) tons, they will be applied to each container 66, and they are more than adequate to cause each such container to rise upwardly out of the recess therefor.

The sizes, as well as the configurations, of the containers 66, and the sizes, as well as the configurations, of the recesses therefor, can be varied as long as the critical relationships between those containers and the recesses therefor are preserved. Specifically, those recesses must be made strong enough, and must provide sufficient face-to-face support for the sides of containers 66, to fully support those containers and their contents. Also, the horizontal dimension of the top of each recess must be appreciably larger than the horizontal dimension of the bottom of that recess, and the walls of that recess must not constitute obstructions between the bottoms and tops thereof. However, the sides and ends of those recesses could be constituted by fabricated open-type frames rather than by plates, as long as those sides and ends provided the required support for the containers. The inverted frusto-pyramidal configurations of the lower portions of the containers 66, and of the recesses therefor, are preferred. Not only do they foster ready separation of the containers 66 from the recesses therefor, but they tend to cause those containers to float upright in the water. However, configurations could be used wherein at least one of the sides and one of the ends of each container 66, and of the corresponding recess therefor, could be vertical. In each case, at least one side wall and one end wall of each container and of the recess therefor should incline outwardly and upwardly relative to the geometric center of that container or recess. As a result, each recess provided by the present invention will permit the correspondingly-configured container therein to respond to the weight of the water which it displaces to rise upwardly and away from that recess.

The partitions 70 and 72 are desirable because they strengthen the containers 66. Those partitions also are desirable because they enable those containers to function both as cargo and/or segregated ballast tanks (SBTs).

The structural supports 14, the decking 16, and the plates 56 and 58 are located well below the water line of the ship 10. As a result, portions of the containers 66 also are located well below that water line. The upper portions of those containers project above the deck 12, and hence increase the carrying capacity of the ship.

The tubular passages 40, 48 and 54 permit air inside the ship's hull to circulate along the surface of the containers 66 and help prevent surface rust or corrosion. The protective coatings, such as Teflon, which may be used on the exteriors of the containers 66 and on the interiors of the recesses therefor should have smooth hard finishes. Such finishes can protect the surface and facilitate the separation of those containers from those recesses in the event the ship 10 sinks. If desired, a conventional lubricant may be used to coat the exteriors of the containers 66 or the interiors of the recesses for those containers to additionally facilitate the separation of those containers from those recesses.

The containers 66, as well as the recesses therefor, can be fabricated at locations other than the shipyard where the ship 10 is built. Moreover, those containers and recesses can be built on assembly lines. Such an approach to ship-building saves construction time and increases shipyard capacity.

In the event the ship 10 is scrapped or sunk, the containers 66 can be removed and installed aboard a replacement vessel. As a result, the present invention provides a substantial savings in the event of the scrapping or sinking of the original ship. Such savings would be in addition to the savings provided by recovering the oil from the sunken ship and by obviating ecological, economic, and recreational damage.

Although the present invention is intended for use with ships that transport lighter-than-water fluids, it is also usable with ships that transport heavier-than-water fluids. The containers 66 would not rise up from the ship 10 if those containers were filled with heavier-than-water fluids, but they would prevent ecological, economic, and recreational damage. Also, those containers would permit recovery of those heavier-than-water fluids if the ship sank in relatively shallow waters.

The present invention has been shown and described in connection with a self-propelled ship. However, that invention is usable with ships, barges, vessels and all other kinds of water-borne cargo transports, whether self-propelled or towed.

Whereas the drawing and accompanying description have shown and described a preferred embodiment of the present invention, it should be apparent to those skilled in the art that various changes may be made in the form of the invention without affecting the scope thereof.

What I claim is:

1. A ship which is adapted to carry fluids and that comprises a plurality of members which are fixedly secured within the hull of said ship to define a plurality of large open-top, transversely-spaced and laterally-spaced recesses which have the lower areas thereof disposed below the water line of said ship, said members being mounted so the horizontal area of the upper portion of each recess is larger than the horizontal area of the lower portion of said recess, a plurality of large, substantially fluid-tight containers that normally are disposed within said recesses, said containers having configurations which enable portions thereof to bear against and to receive support from confronting portions of said recesses, said portions of said containers and said confronting portions of said recesses providing areas of engagement which are substantially greater than line contacts, said containers having partitions therein which subdivide each of said containers into a plurality of substantially fluid-tight compartments, said containers having the lower areas thereof extending below said water line of said ship, said portions of said containers and said confronting portions of said recesses being free of locking members whereby said containers are held within said recesses solely by the force of gravity and by frictional forces, said containers being supported and held within said ship, by gravity and by said frictional forces and the resulting engagements between said portions of said containers and said confronting portions of said recesses, throughout the entire periods of time when fluids are introduced into or removed from said containers, some of said portions of said containers being parts of the sides of said containers which are intermediate said partitions and the ends of said containers and which respond to the weights of the fluid contents of said containers to bow outwardly and apply forces to the sides of said recesses that resist separation of said containers from said recesses while said ship is afloat, said some portions of said containers when said containers are filled with lighter-than-water fluids, responding to any sinking of said ship to automatically bow away from said sides of said recesses and thereby help said containers float up out of said recesses and rise to the surface of the water being holding and confining the fluid contents thereof to prevent the loss therefrom of the fluid contents thereof, said containers having portions thereof which engage confronting portions of said recesses adjacent the upper edges of said recesses to render said open-top recesses substantially closed-top recesses whenever said containers are disposed within said recesses.

2. A ship which is adapted to carry lighter-than-water fluids and that comprises a plurality of members which are fixedly secured within the hull of said ship to define a plurality of large open-top spaced-apart recesses which have the lower areas thereof disposed below the water line of said ship, said members being mounted so the horizontal area of the upper portion of each recess is larger than the horizontal area of the lower portion of said recess, a plurality of large, substantially fluid-tight containers that normally are disposed within said recesses, said containers having configurations which enable portions thereof to bear against and to receive support from confronting portions of said recesses, said portions of said containers and said confronting portions of said recesses providing areas of engagement which are substantially greater than line contacts, said containers having the lower areas thereof extending below said water line of said ship, said portions of said containers and said confronting portions of said recesses being free of locking members whereby said containers are held within said recesses soley by the force of gravity and by frictional forces, said containers being supported and held within said ship, by gravity and by said frictional forces and the resulting engagements between said portions of said containers and said confronting portions of said recesses, throughout the entire periods of time when fluids are introduced into or removed from said containers, some of said portions of said containers being parts of the sides of said containers which respond to the weights of said containers and to the weights of the fluid contents of said containers to bow outwardly and apply forces to the sides of said recesses that resist separation of said containers from said recesses while said ship is afloat, said containers having volume-to-weight relationships which enable them and the lighter-than-water fluids therein to automatically free themselves from said recesses and rise to the surface of the water while holding and confining the fluid contents thereof to prevent the loss therefrom of the fluid contents thereof in the event said ship sinks.

3. A ship as claimed in claim 2 wherein each of said recesses has an opening therein to permit ingress of water during said sinking of said ship.

4. A ship as claimed in claim 2 wherein said containers have the middle and lower portions thereof disposed within said recesses but have the upper portions thereof extending above the deck of said ship, whereby said upper portions of said containers provide additional fluid-carrying capacity for said ship.

5. A ship as claimed in claim 2 wherein said recesses have substantial portions of the sides thereof confronting, and being able to prevent unlimited outward bowing of, corresponding portions of the sides of said containers.

6. A ship as claimed in claim 2 wherein each of said containers has a transversely-extending partition therein, and wherein portions of the walls of said containers that are intermediate said partitions and the adjacent ends of said containers respond to the filling of said containers with fluid to bow outwardly into intimate engagement with corresponding portions of the inner surfaces of said recesses.

7. A ship as claimed in claim 2 wherein each of said containers has at least one partition therein, and wherein said partitions perform the dual functions of subdividing said containers into pluralities of separate substantially liquid-tight compartments and of providing predetermined dimensions for said containers.

8. A ship as claimed in claim 2 wherein each of said containers has a configuration that is at least one inch narrower than the corresponding configurations of the recess for said container, whereby said containers are readily inserted into and removed from said recesses and will "fully bottom" while they are within said recesses.

9. A ship as claimed in claim 2 wherein said recesses have flange-like upper edges which are welded to, and serve as portions of, the deck of said ship.

10. A ship as claimed in claim 2 wherein the engagement between middle and lower areas of said containers with the confronting areas of said recesses keeps said containers from shifting relative to said recesses even if said ship is storm-tossed.

11. A ship as claimed in claim 2 wherein middle and lower portions of said containers have configurations which are complementary to confronting areas of said recesses, and wherein said middle and lower portions of said containers intimately engage said confronting areas of said recesses.

12. A ship as claimed in claim 2 wherein said containers have the middle and lower portions thereof disposed within said recesses but have the upper portions thereof extending above the deck of said ship, whereby said upper portions of said containers provide additional fluid-carrying capacity for said ship, and wherein the horizontal area of the top of said upper portion is smaller than the horizontal area of the bottom of said upper portion.

* * * * *